United States Patent [19]

Weckerly

[11] 4,249,376

[45] Feb. 10, 1981

[54] PUMP JACKS

[76] Inventor: Darl E. Weckerly, c/o Weckerly Associates, 388 Seneca St., Oil City, Pa. 16301

[21] Appl. No.: 914,994

[22] Filed: Jun. 13, 1978

[51] Int. Cl.[3] ..... F01L 25/08; F04B 47/04

[52] U.S. Cl. ..... 60/369; 60/413; 60/456; 60/468; 60/478; 91/50; 166/68.5

[58] Field of Search ..... 60/369, 371, 413, 456, 60/458, 477, 478, 468, 494, DIG. 5, 372, 329; 74/41; 91/218, 277, 325, 400, 303, 286, 50; 92/117, 118, 161; 166/68.5; 417/399, 400, 401, 390

[56] References Cited

U.S. PATENT DOCUMENTS

| | | | |
|---|---|---|---|
| 245,101 | 8/1881 | Thayer et al. | 166/68.5 |
| 1,242,548 | 10/1917 | Harris | 417/401 X |
| 1,870,499 | 8/1932 | Ernst | 91/402 |
| 2,072,595 | 3/1937 | Hutchison | 60/372 |
| 2,099,779 | 11/1937 | Tremolada | 92/161 |
| 2,136,986 | 11/1938 | Vernon et al. | 60/369 |
| 2,265,379 | 12/1941 | Lyne | 74/41 |
| 2,325,874 | 8/1943 | O'Leary | 74/414 |
| 2,614,803 | 10/1952 | Wiggins | 166/68.5 X |
| 2,729,941 | 1/1956 | Rose et al. | 91/291 X |
| 2,984,985 | 5/1961 | MacMillin | 60/471 X |
| 3,163,005 | 12/1964 | Reed | 92/161 |
| 3,405,605 | 10/1968 | Ross | 91/173 |
| 3,498,061 | 3/1970 | Prucha et al. | 60/329 |
| 3,867,846 | 2/1975 | Cambern | 74/41 |
| 3,977,254 | 8/1976 | Goldfein | 74/41 |

FOREIGN PATENT DOCUMENTS

| | | | |
|---|---|---|---|
| 123321 | 1/1947 | Australia | 60/478 |
| 239475 | 12/1924 | United Kingdom | 60/468 |

*Primary Examiner*—Irwin C. Cohen

*Attorney, Agent, or Firm*—Buell, Blenko, Ziesenheim & Beck

[57] ABSTRACT

A pump jack for pumping oil and like wells having a polish rod extending vertically out of a well casing is provided including a frame adapted to fit over said well, a hydraulic cylinder depending from said frame generally coaxially of said polish rod, a piston movable in said cylinder and having an end engaging said polish rod, a source of high pressure fluid connected to said cylinder for raising said piston in the cylinder, dump means on said frame simultaneously discharging the raising fluid from said cylinder and by-passing fluid from said source of high pressure fluid to said source of fluid, means on said piston selectively actuating said dump valve from a first position where all fluid from the source of high pressure fluid is delivered to one side of the cylinder for raising the piston to a second position where all fluid from the source and from said one side of the piston is simultaneously returned to the source and to the other side of the cylinder whereby the piston and polish rod are successively raised and lowered vertically relatively to the cylinder.

7 Claims, 5 Drawing Figures

PUMP JACKS

This invention relates to pump jacks and particularly to a hydraulic pump jack for pumping fluids from deep earth bores such as oil wells and the like.

The practice of pumping oil and like fluids from deep earth bores such as oil wells is common and has been for many years. Pump jacks of the walking beam type mounted on skids are a common sight throughout oil field country. These pump jacks are massive in size and use large counterweighted pivot arms for reciprocating a pump rod in a well casing to lift fluid from several thousand feet in the earth. Large pressures are involved in the reciprocating movement of these pumps parts. Such pumps are costly to buy, costly to maintain and costly to operate. Typical of such pump jacks are those disclosed in U.S. Pat. Nos. 2,265,379 and 3,867,846. In an effort to overcome the use of massive counterweights in such jacks, the use of counterbalance cylinders has been proposed as in U.S. Pat. No. 2,325,874. In addition, the use of hydraulic pump jacks to operate the walking beam of such pumps has been suggested in U.S. Pat. Nos. 3,405,605 and 3,977,259.

The need for a less expensive apparatus which would be lighter in weight and less costly to maintain and operate has long been recognized by men in this field of operations. In an effort to solve this problem the use of a double acting hydraulic piston as a substitute for a walking beam has been tried experimentally but with less than satisfactory results because of the problems of quickly and repeatedly cycling the cylinder in order to obtain a pumping action and in supplying a sufficient quantity of high pressure fluid at each cycle reversal with a reasonably sized fluid system which would not be as bulky and expensive as the walking beam pump jacks it is intended to replace, particularly where great depths (in excess of 1,000 feet) are involved.

The present invention provides a pump jack which is very light in weight and readily moved from one site to another. It is relatively inexpensive in first cost as compared to the conventional walking beam pump jack and much less costly to maintain and operate than anything heretofore available.

I provide a frame adapted to fit over a well having a polish rod extending vertically therefrom, a hydraulic cylinder depending from said frame above said polish rod, a piston movable vertically in said cylinder generally coaxially of said polish rod and having a free end engaging said polish rod, a dump valve on one of said frame and cylinder, a source of continuous high pressure fluid on said frame connected to said dump valve, a connection from said dump valve to said cylinder, a connection from said dump valve to said source of fluid and means on said piston selectively actuating said dump valve from a first position wherein said dump valve delivers high pressure fluid from said source of fluid to said cylinder to cause the piston to be carried into the cylinder and lift the polish rod in the well casing and to a second position wherein said dump valve empties the cylinder and returns fluid to the source of fluid whereby the piston extends out of the cylinder and the polish rod moves downwardly in the well casing. Preferably the source of high pressure fluid includes an accumulator and a pump, the accumulator receiving fluid under pressure from the piston with the dump valve in second position and delivering fluid under pressure to said pump. The frame is preferably of triangular cross section having a top which tapers pyramidally to an apex from which the cylinder depends. The hydraulic cylinder is preferably mounted on the frame in a universally movable swivel mounting. Preferably, I provide a hydraulic fluid heat exchanger with means for heat exchange between the hydraulic fluid and liquid pumped from the well. Preferably the heat exchanger is on the return connection from the cylinder to the source of pressure fluid.

In the foregoing general description I have set out certain objects, purposes and advantages of this invention. Other objects, purposes and advantages of this invention will be apparent from a consideration of the following description and the accompanying drawings in which.

Figure 1:
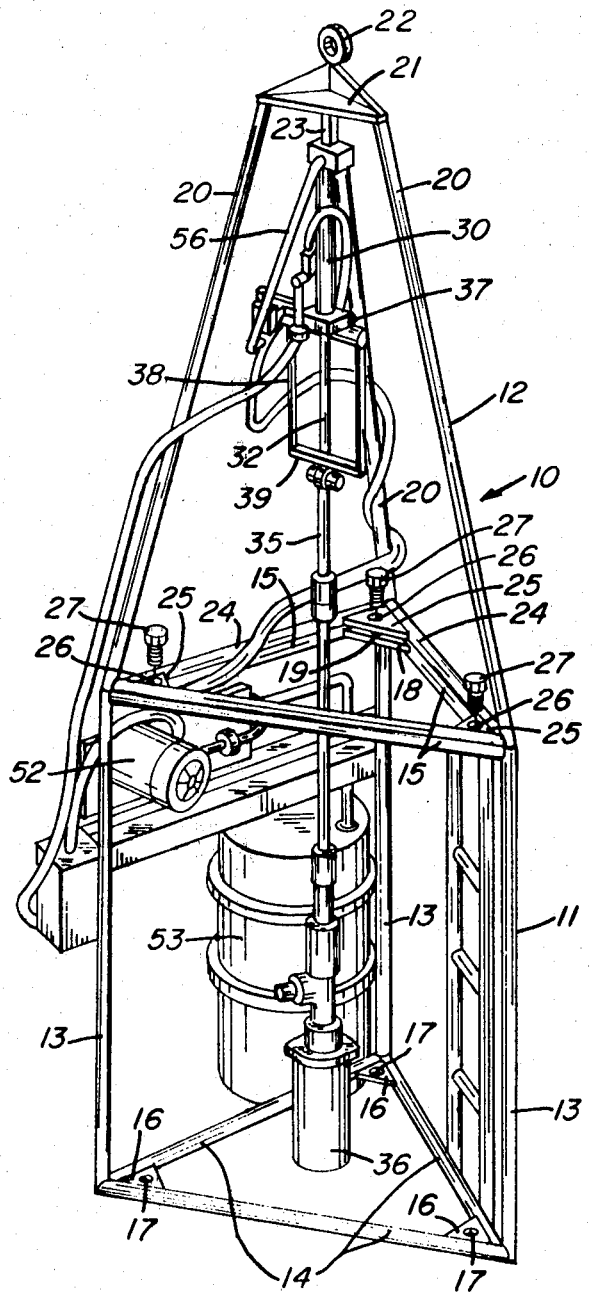
FIG. 1 is an isometric view of a pump jack according to this invention.

Referring to the drawings I have illustrated a two part frame 10 of triangular section made of tubular members. The frame is made up of a bottom section 11 of uniform section throughout its length and a top section 12 of generally pyramidal shape. The bottom 11 is made up of three corner posts 13 connected by three side members 14 at the bottom and three side members 15 at the top. Gusset plates 16 having center holes 17 are placed in each bottom corner between side members 14 and corner posts 13. Similar gusset plates 18 having holes 19 are placed in each top corner between side members 15 and posts 13. The pyramidal top section 12 is made up of three corner posts 20 which are connected by an apex cap 21 at the top. Cap 21 is provided on its top surface with a lift ring 22 and directly below the lift ring on the bottom of cap 21 with a clevis 23. The bottom ends of posts 20 are connected by the three side members 24 adapted to lie on top of members 15 of bottom section 11. Gusset plates 25 having holes 26 which align with holes 19 of gusset plates 18 are placed in each corner between side members 24 and posts 20. Bolts 27 through holes 26 and 19 hold the top section 12 and bottom section 11 together.

A hydraulic cylinder 30 is suspended vertically beneath clevis 23 by a universal connector 31. A piston having a rod 32 in cylinder 30 carries a clevis 33 which connects to a ring 34 on a polish rod 35 which extends out of a well casing 36 in an oil or like well. The polish rod 35 connects to a conventional sucker pump, not illustrated. A valve plate 37 is fixed to the bottom end of cylinder 30 around piston rod 32 and is provided with a guide rod 38 which extends parallel to the axis of the cylinder 30 and piston rod 32 spaced from and alongside the extended piston rod 32. A horizontal elongate guide bar 39 is fixed on the end of piston rod 32 at clevis 33 and has a guide hole 40 at one end which slidingly fits around guide rod 38. The other end of guide bar 39 is provided with a vertically extending trip rod 41 which extends vertically upwardly spaced from and parallel to piston rod 32. Trip rod 41 carries a top trip collar 42 and a bottom trip collar 43 arranged to engage arm 45*a* on limit switch 45 mounted on plate 37.

A solenoid operated dump valve 50 is mounted on plate 37 and is connected to limit switch 45 which controls the solenoid of valve 50. A high pressure fluid line 51 connects port 30*a* at the bottom of cylinder 30 with a fluid pump 52 which delivers fluid under pressure from reservoir 53 through T 54 and line 54*a*. Return line 55 connects T 54 through dump valve 50 with reservoir 53. A separate line 56 connects reservoir 53 with the upper end of cylinder 30. Oil cooler 57 is interposed in line 55 between dump valve 50 and reservoir 53. This oil cooler is used to exchange heat from the fluid in line 55 to the fluid being pumped from the well.

Figure 2:
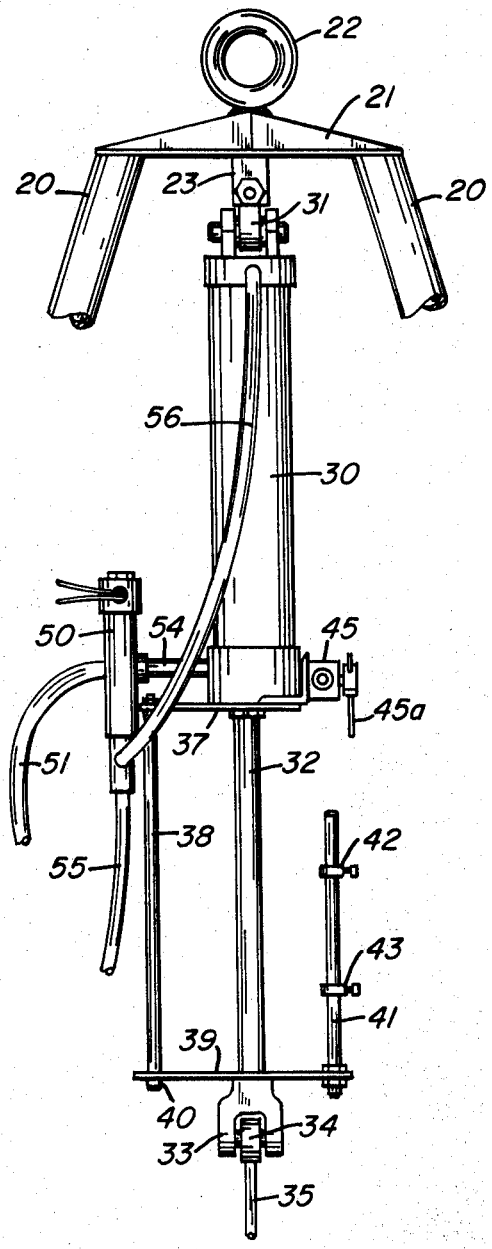
FIG. 2 is a fragmentary side elevation view of the pump jack of FIG. 1 showing the lift cylinder, solenoid switch and dump valve.
Figure 3:
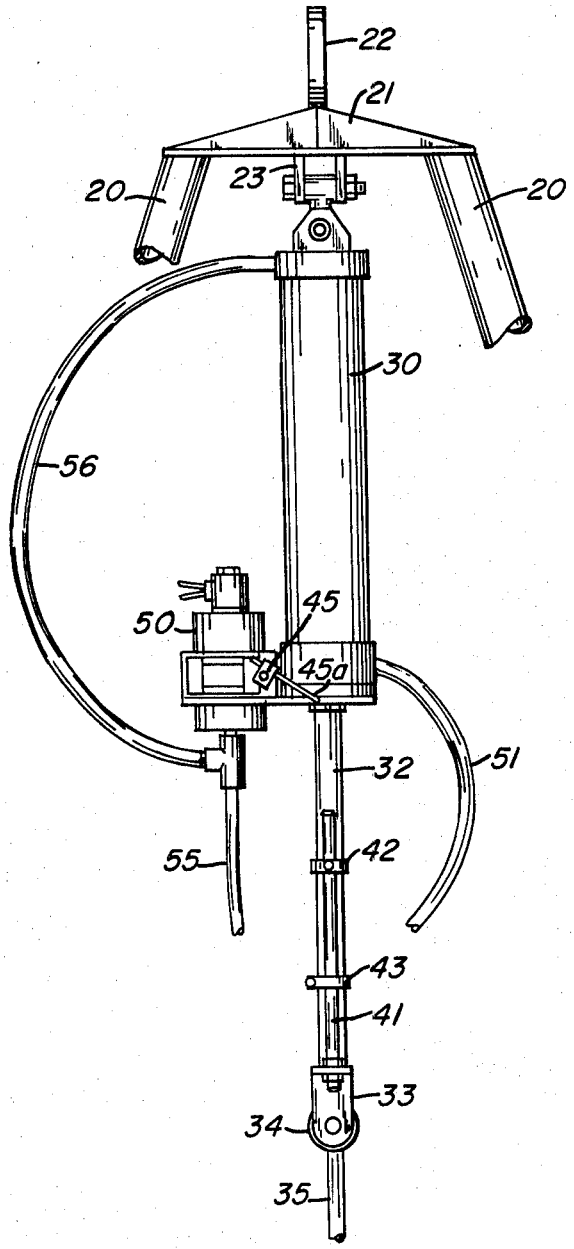
FIG. 3 is a side elevational view from the right of FIG. 2.
Figure 4:
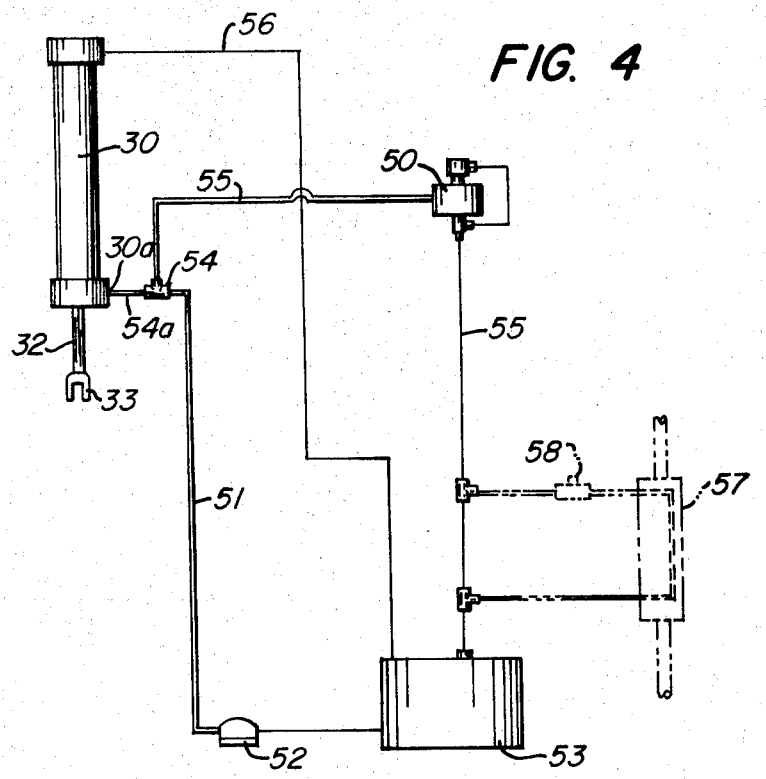
FIG. 4 is a schematic view of the hydraulic system of the apparatus of FIG. 1.

In operation the pump 52 delivers high pressure fluid to T 54 where, assuming the dump valve 50 is closed and piston rod 32 is extended out of cylinder 30, as in FIGS. 2 and 3, the fluid is delivered through line 54*a* to cylinder 30 raising piston and attached rod 32 and polish rod 35. As soon as bottom trip collar 43 reaches lever 45*a* on limit switch 45, dump valve 50 is opened and fluid from pump 52 is by-passed to line 55 and back to reservoir 53. At the same time the weight of polish rod 35 draws piston and attached rod 32 downwardly within cylinder 30. The action of the load on polish rod 35 ejects fluid from the lower end of the piston into line 55. This fluid is returned to reservoir 53 directly or by way of oil cooler 57 controlled by thermostat 58. As soon as top trip collar reaches lever 45*a*, it deactivates switch 45 and dump valve 50 closes, repeating the cycle. The result is a regular cyclic reciprocating motion on piston rod 32 and polish rod 35 which pumps fluid from the well.

Figure 5:
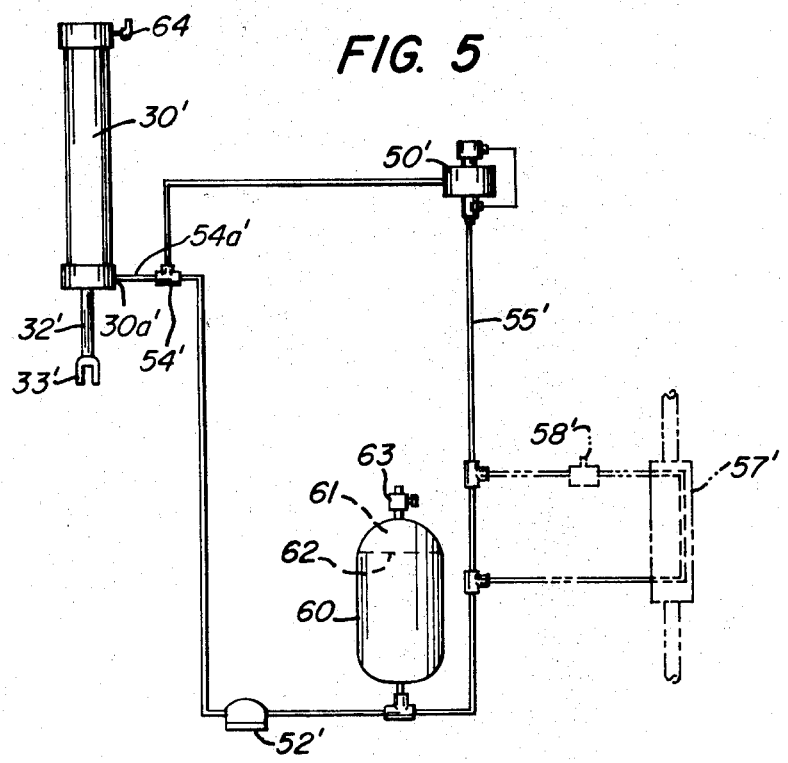
FIG. 5 is a schematic view of a second and preferred embodiment of hydraulic system for the apparatus of this invention.

In the embodiment of FIG. 5 all parts of the apparatus are the same and bear like numbers with a prime sign except that an accumulator 60 is substituted for reservoir 53 and a breather fitting 63 is substituted for line 56. Accumulator 60 is effectively a closed pressurized reservoir having an air cushion 61 above the pool of oil 62. The level of air pressure may be changed through air fitting 63. Changing the air pressure and thus the pressure on the oil, increases the pressure and rate of fluid delivered by pump 52' so that the apparatus can be adjusted effectively to pump at great depths which require high pressures with rapid build-up in order to pump efficiently.

In the foregoing specification I have set out certain preferred practices and embodiments of this invention, however, it will be understood that this invention may be otherwise embodied within the scope of the following claims.

I claim:

1. A pump jack for pumping oil and like wells having a polish rod extending vertically out of a well casing comprising a movable ground supported frame fitting over said well, a universal connector means attached to said frame, a hydraulic cylinder, said hydraulic cylinder depending at one end from said universal connector means generally coaxially of said polish rod, a piston movable in said cylinder and having a piston rod extending from the other end of said cylinder and engaging said polish rod, a plate means connected to said other end of said cylinder, a source of high pressure fluid connected to said cylinder for raising said piston in the cylinder, a solenoid operated dump valve mounted on said plate means simultaneously discharging the raising fluid from said cylinder and by-passing fluid from said source of high pressure fluid back to said source of high pressure fluid, a limit switch means mounted on said plate means for controlling said solenoid operated valve, means on said piston rod selectively actuating said dump valve by engagement with said limit switch means from a first position wherein all fluid from the source of high pressure fluid is delivered to one side of the cylinder for raising the piston to a second position wherein all fluid from the source and from said one side of the piston is simultaneously returned to the source whereby the piston and polish rod are successively raised by the high pressure fluid and the piston is lowered by the weight of the polish rod vertically relative to the cylinder.

2. A pump jack as claimed in claim 1 wherein the source of high pressure fluid is a pump mounted on the frame and connected to a reservoir.

3. A pump jack as claimed in claim 1 wherein the frame is of tubular metal arranged in triangular cross section having at least a top part in pyramidal shape.

4. A pump jack as claimed in claim 3 wherein the frame is in two sections, a bottom section of uniform triangular section from top to bottom and a top section in pyramidal form, said sections being removably fastened together.

5. A pump jack as claimed in claim 1 having a heat exchanger between the dump valve and source of fluid through which the high pressure fluid is passed in heat exchange relationship with a fluid being pumped from the well.

6. A pump jack as claimed in claim 1 wherein the source of pressure fluid includes an accumulator and fluid pump.

7. A pump jack as claimed in claim 6 wherein the accumulator receives fluid from the dump valve and delivers pressurized fluid to the pump.

* * * * *